US011904253B1

(12) United States Patent
Kahn

(10) Patent No.: US 11,904,253 B1
(45) Date of Patent: Feb. 20, 2024

(54) FIDGET TOY

(71) Applicant: Jason Kahn, Holmdel, NJ (US)

(72) Inventor: Jason Kahn, Holmdel, NJ (US)

(73) Assignee: Kahn Creatives LLC, Holmdel, NJ (US)

( * ) Notice: Subject to any disclaimer, the term of this patent is extended or adjusted under 35 U.S.C. 154(b) by 0 days.

(21) Appl. No.: 18/315,096

(22) Filed: May 10, 2023

Related U.S. Application Data

(60) Provisional application No. 63/476,822, filed on Dec. 22, 2022.

(51) Int. Cl.
*A63F 9/08* (2006.01)
*A63H 33/00* (2006.01)
*A63H 3/16* (2006.01)

(52) U.S. Cl.
CPC ..... *A63H 33/00* (2013.01)

(58) Field of Classification Search
CPC ... A63H 1/00; A63H 5/00; A63H 3/16; A63H 17/002; A63H 33/008; A44C 9/00; A63F 9/08
USPC ..... 446/233, 487; 273/153 S
See application file for complete search history.

(56) References Cited

U.S. PATENT DOCUMENTS 2,457,447 A 12/1948 Cohn
2,958,959 A * 11/1960 Hubbard ..... G09B 27/08 434/131
3,316,672 A 5/1967 Dixon
3,596,380 A * 8/1971 Williams ..... A44C 17/0258 446/236
3,898,762 A 8/1975 Balleis
4,643,692 A 2/1987 Magers
4,645,471 A 2/1987 Herring et al.
5,591,062 A 1/1997 Hettinger
6,209,846 B1 * 4/2001 Barlow ..... G06F 1/1601 312/223.1
10,016,693 B1 7/2018 Dowdy et al.
10,449,466 B2 10/2019 Kinmont, Jr.
11,471,782 B2 10/2022 Rubin et al.
2013/0270768 A1 * 10/2013 Carlow ..... A63F 9/0826 273/148 R
2016/0232804 A1 8/2016 Nichols et al.
2018/0200638 A1 7/2018 Chin
2018/0345155 A1 12/2018 Philgreen et al.
2018/0352829 A1 12/2018 Diamond et al.
2018/0369703 A1 12/2018 Sorias et al.
2020/0238163 A1 7/2020 Anderson

* cited by examiner

*Primary Examiner* — Kien T Nguyen

(74) *Attorney, Agent, or Firm* — Dunlap Bennett & Ludwig, PLLC

(57) ABSTRACT

A fidget toy has a set of three gimbals, wherein two of the gimbals may be in a parallel configuration, while an intermediate gimbal is mounted with an orthogonal pivot axis compared to the other gimbals. The fidget toy may have a spherical core, two successive rings, and a hemispherical outer shell wherein the three gimbals are at the interface of these four objects.

7 Claims, 4 Drawing Sheets

FIDGET TOY

CROSS-REFERENCE TO RELATED APPLICATION

This application claims the benefit of priority of U.S. provisional application No. 63/476,822, filed 22 Dec. 2022, the contents of which are herein incorporated by reference.

BACKGROUND OF THE INVENTION

The present invention relates to spinning and fidget toys, and more particularly, a spherical fidget toy for silent fidgeting with your hands.

Many people with attention deficit hyperactivity disorder (ADHD), or those with nervous energy or temporarily experiencing hyperactivity, tend to fidget with their hands. For a long time, fidgeting has been viewed as a negative symptom that needed to be stopped. The current view of fidgeting is less harsh; however, there are people who need to hone their focus and, by extension, need a device to dissipate their hand fidgeting. However, in places like work and school, that can draw unwanted attention to oneself or may be prohibited if they are too noisy. Current fidgets, e.g., the fidget spinner, can be noisy. They also may attract unwanted attention to the fidgeting user because they are either not discrete or not hand-held.

As can be seen, there is a need for a handheld fidget toy that is silent yet incorporates a lot of moving parts.

SUMMARY OF THE INVENTION

The present invention embodies a three-dimensional printed spherical fidget toy, which is silent, fits in a user's hand, and is easy to travel with so the user can take it out when needed without bringing unwanted attention to themself.

The present invention is less expensive and quieter than the metal fidget spinners currently available because it is fabricated by additive manufacture (three-dimensional printing). The present invention is made from plastic using correctly placed gimbal pins that stick out from each part to balance each part together so that the plurality of parts can spin freely and silently relative to each other.

In one aspect of the present invention, a fidget toy includes the following: four successive objects; and a set of three gimbals, one gimbal mounted on adjacent objects of the four successive object, wherein adjacent gimbals have alternating orthogonal pivot axis, wherein an outermost object of the four successive objects is a hemispherical shell dimensioned and adapted to be cupped in a hand of the user.

In another aspect of the present invention, the fidget toy further includes wherein an innermost object of the four successive objects is a spherical object, wherein two successive objects of the four successive objects are arcuate rings, wherein at least approximately ten percent of the spherical object is visible past the two arcuate rings and the hemispherical shell, wherein an innermost gimbal and an outermost gimbal of the set of three gimbals have a parallel configuration so they pivot about a shared axis, wherein each gimbal comprises two diametrically opposing pivot points, wherein each pivot point comprises an outer surface tab and an inner surface slot, wherein each tab and slot are conical, and wherein the fidget toy is manufactured by way of additive manufacture.

These and other features, aspects and advantages of the present invention will become better understood with reference to the following drawings, description, and claims.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, an embodiment of the present invention provides a fidget toy having a set of three gimbals, wherein two of the gimbals may be in a parallel configuration, while an intermediate gimbal is mounted with an orthogonal pivot axis compared to the other gimbals. The fidget toy may have a spherical core, two successive rings, and a hemispherical outer shell wherein the three gimbals are at the interface of these four objects.

Figure 1A:
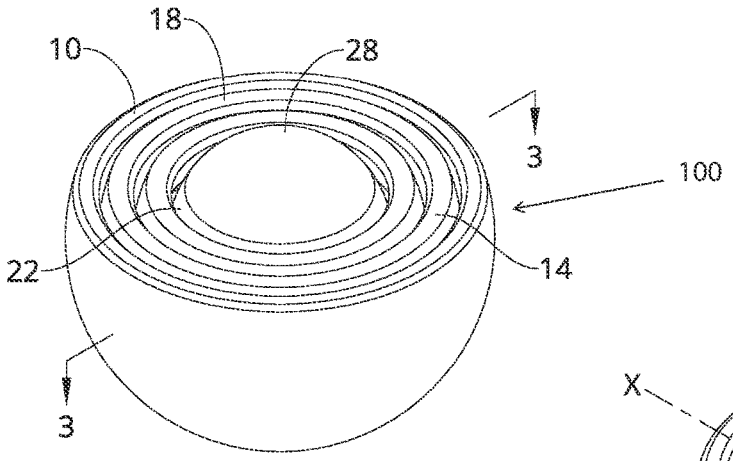
FIG. 1A is a perspective view of an exemplary embodiment of the present invention, shown at rest.
Figure 1B:
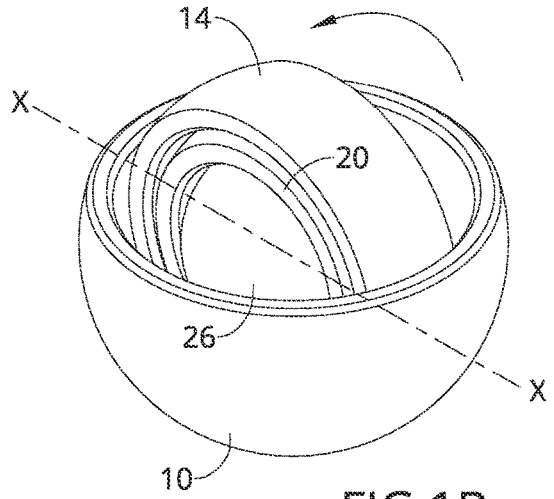
FIG. 1B is a perspective view of an exemplary embodiment of the present invention, showing a core 26, an inner ring 20, and an outer ring 14 beginning to spin on/about the X-axis.
Figure 1C:
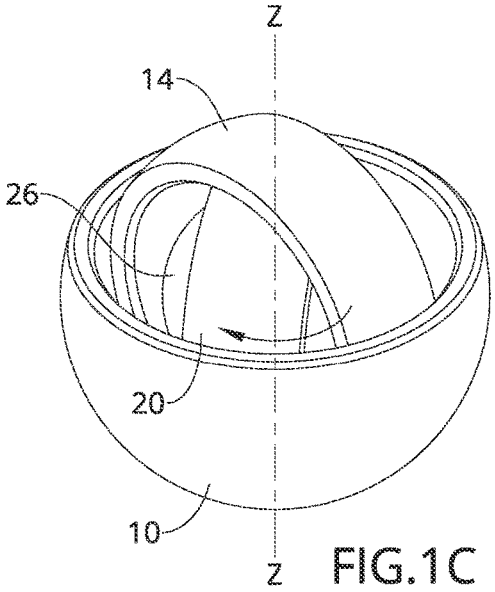
FIG. 1C is a perspective view of an exemplary embodiment of the present invention, showing the core 26, the inner ring 20, and the outer ring 14 turning on/about the Z-axis.
Figure 1D:
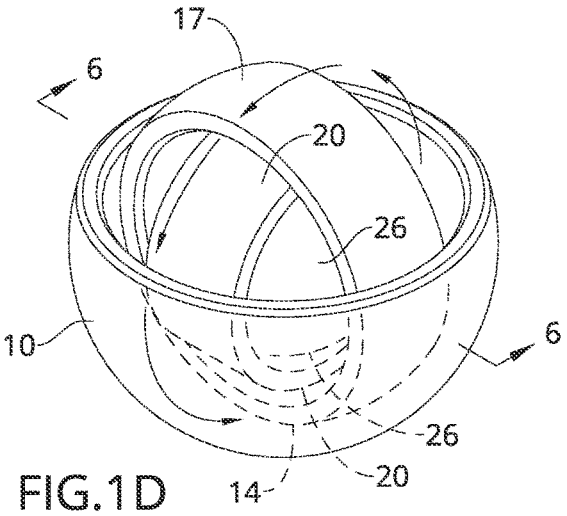
FIG. 1D is a perspective view of an exemplary embodiment of the present invention, showing a sustained spinning position with the core 26, the inner ring 20, and the outer ring 14 spinning on/about the X-axis, wherein the inner ring 20 is oriented ninety-degrees, about the Z-axis, relative to the inner ring 20 orientation in FIG. 1B, even though they are both rotating about the X-axis.
Figure 2:
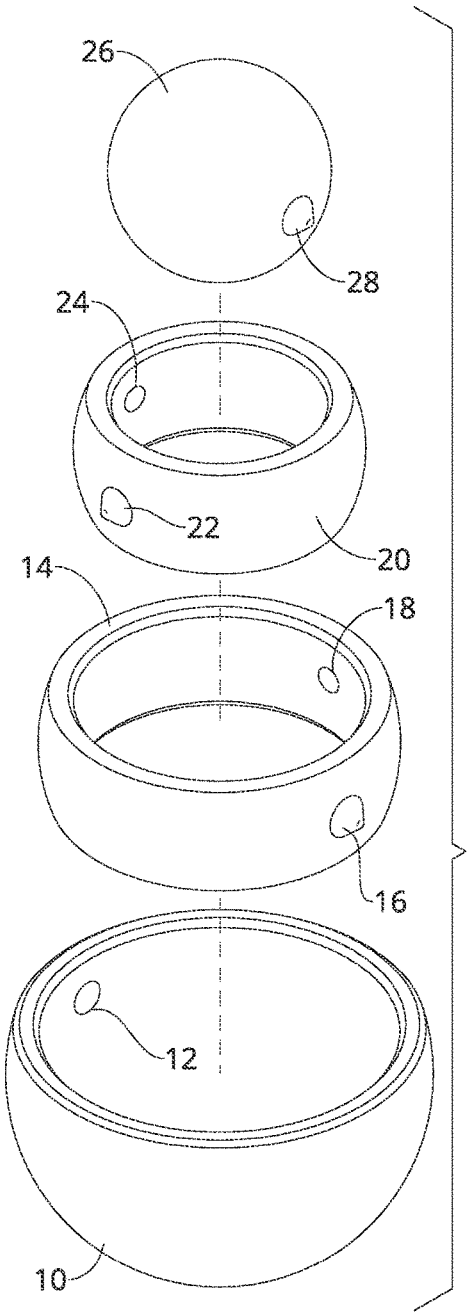
FIG. 2 is an exploded perspective view of an exemplary embodiment of the present invention.
Figure 3:
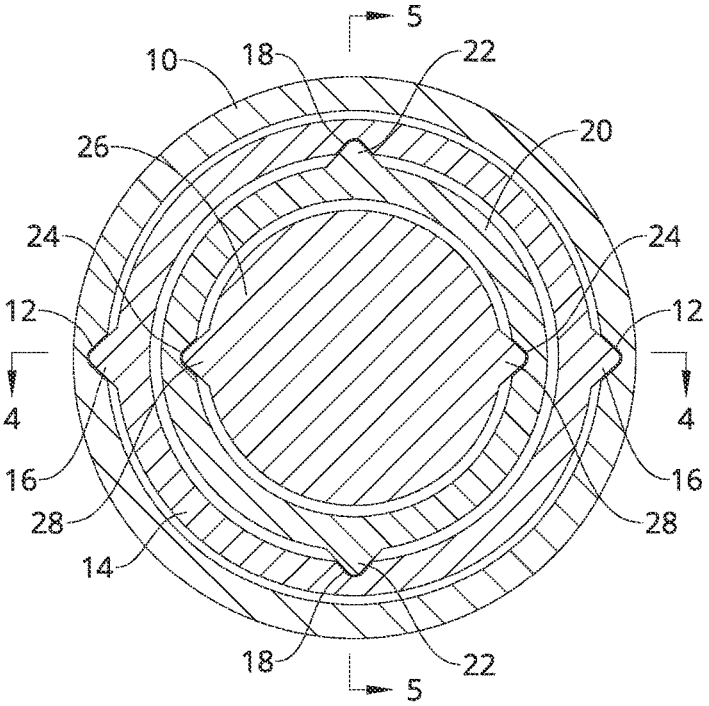
FIG. 3 is a section view of an exemplary embodiment of the present invention, taken along line 3-3 in FIG. 1A.
Figure 4:
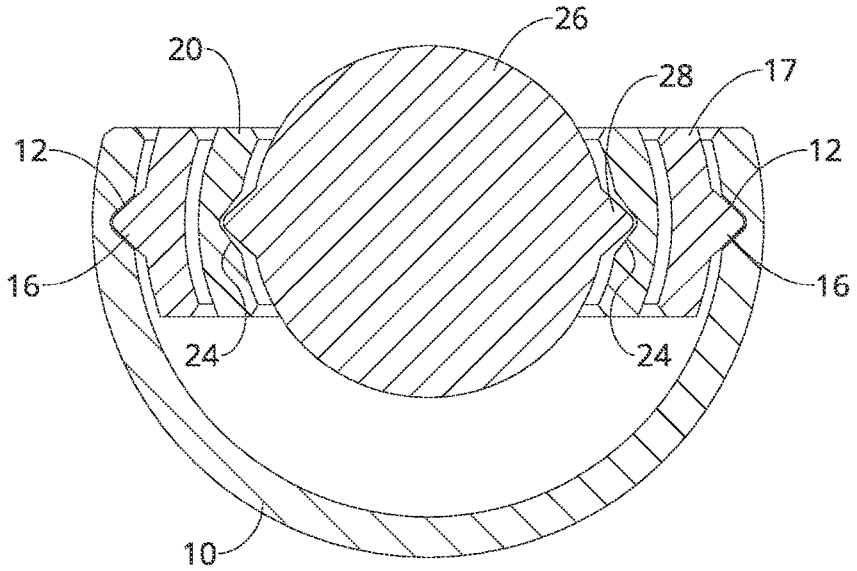
FIG. 4 is a section view of an exemplary embodiment of the present invention, taken along line 4-4 in FIG. 3.
Figure 5:
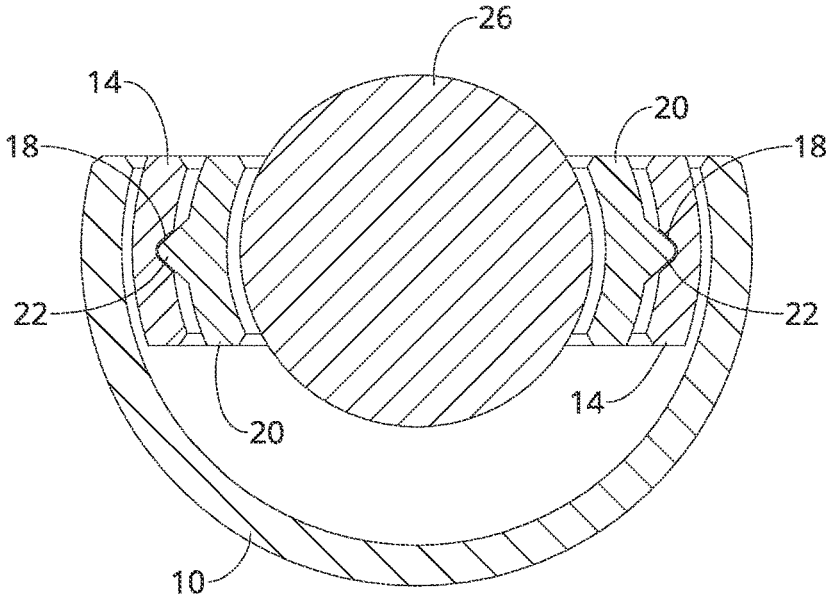
FIG. 5 is a section view of an exemplary embodiment of the present invention, taken along line 5-5 in FIG. 3.
Figure 6:
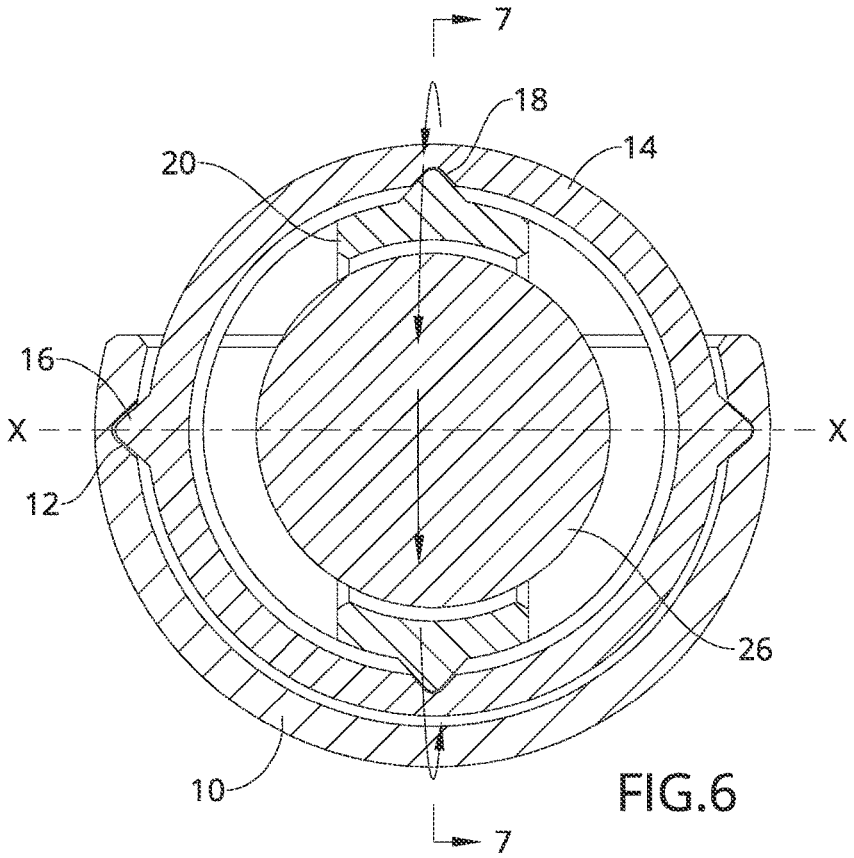
FIG. 6 is a section view of an exemplary embodiment of the present invention, taken along line 6-6 in FIG. 1D, showing the motion of core 26 and the inner ring 20.
Figure 7:
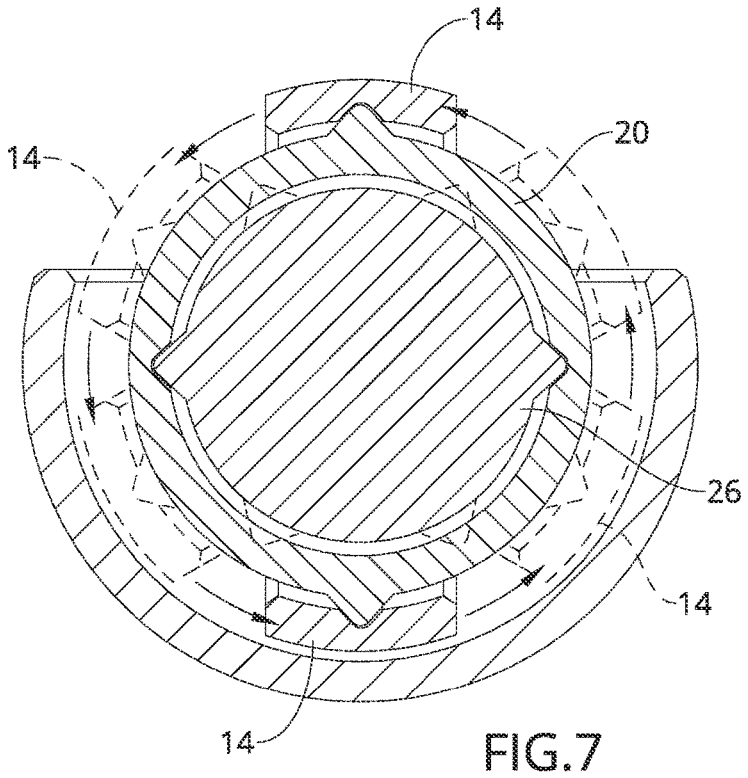
FIG. 7 is a section view of an exemplary embodiment of the present invention, taken along line 7-7 in FIG. 6, showing the motion of the outer ring 14 around the X-axis, while the core 26 and the inner ring 20 are locked in a parallel configuration about the Z-axis.

Referring now to FIGS. 1 through 7, the present invention may include a fidget toy 100. The fidget toy 100 may have a semi-spherical outer shell 10 that accommodates by way of three successive gimbals an inner-most core 26 that will maintain its spin axis direction regardless of the orientation of the outer shell 10, thereby enabling freedom of rotation in at least two orthogonal axes for the intermediate two rings 14 and 20.

The core 26 may be a spheroid, though other shapes are contemplated if the present invention functions as disclosed herein. For instance, the core 26 could be any shape that enables support of diametrically opposing core pivot points 28, which facilitate the axis rotational freedom of a gimbal by provide a shared axis of rotation relative to the core 26 and its adjacent object, a first ring 20.

Like the core 26, the first ring 20 may be other shapes than the arcuate one shown in the Figures, as long as the first ring/object 20 provides diametrically opposing first inner pivot points 24 (that simultaneously operatively associate with the core pivot points 28) and diametrically opposing first outer pivot points 22 that are offset ninety degrees relative to first inner pivot points 24. The first inner pivot points 24 are along an inner surface of the first ring 20, while the first outer pivot points 22 are along an outer surface of the first ring 20.

A second ring 14 may adjacent to and outward of the first ring 20. Like the first ring 20, the second ring 14 may be other shapes than the arcuate one shown in the Figures, as long as the second ring/object 14 provides diametrically opposing second inner pivot points 18 (that simultaneously operatively associate with the first outer pivot points 22) and diametrically opposing second outer pivot points 16 that are offset ninety degrees relative to second inner pivot points 18. The second inner pivot points 24 are along an inner surface of the second ring 14, while the second outer pivot points 16 are along an outer surface of the second ring 14.

The outer shell 10 may be hemispheric shell (or hollowed out hemisphere); though it is understood that outer shapes may be usable as long as the outer shell provides shell inner pivot points 12 are diametrically opposite along an inner surface of the outer shell 10.

The operative association of two pivot points—e.g., 12 and 16, 18 and 22, 24 and 28—forms a gimbal or a pivoted support that permits rotation about an axis of first object associated with the first pivot point and a second object associated with the second pivot point (e.g., outer shell 10, associated with pivot point 12, relative to the second ring 14 associated with pivot point 16). Accordingly, the fidget toy 100 provides a set of three gimbals, one mounted on the other with an orthogonal pivot axis. The three sets of gimbals allow the core 26 mounted on the innermost gimbal to remain independent of the rotation of its supporting gimbal (24-28). The gimbal or pivotable mounting may be achieved via ball and socket joints or the like (i.e., even though the present invention shows conic tabs and slots, the present invention contemplates ball-bearing joints and any other type of joints between gimbals as long as they function as disclosed herein).

Referring to FIGS. 1A through 1D, the fidget toy 100 with three gimbals, one mounted on the other with orthogonal pivot axis, thereby allowing the central object (core 26) mounted on the innermost gimbal 24-28 to remain independent of the rotation of that support. The innermost gimbal 24-28 and the outermost gimbal 12-16 support points may share a pivotable orientation and thus an axis in its own plane as determined by the same gimbal support orientation—i.e., "a parallel configuration". The first ring 20, embodying an intermediate gimbal pair 18-22, between innermost gimbal 24-28 and the outermost gimbal 12-16, has a gimbal orientation/pivot axis orthogonal relative to the other gimbal (pair of associated pivot points).

In certain embodiments, the fidget toy 100 has only two degrees of freedom along three-dimensional space as the axis of two of the three gimbals are driven into a parallel configuration, "locking" the system into rotation in a degenerate two-dimensional space. In other words, all three gimbals can still rotate freely about their respective axis of suspension. Nevertheless, because of the parallel orientation of two of the gimbals' axis (the innermost and outermost gimbals) there is no gimbal available to accommodate rotation about one axis, here the Y-axis as shown in FIGS. 1A through 1D.

In use, a user holds the outer shell 10 in their hand, and the gimbal and the associated objects can be manipulated by the user's fingers, relieving fidgeting energy and dissipating stress in a quiet manner due to the conical tabs and slots defining each pivot point.

The present invention can be manufactured with a (three-dimensional) 3D printer, as they may need to be made individually. The process may involve running with tight belts, hardened plastic wheels on the X and Y axis, 0.04 nozzle on the machine, running at 10 mm/s. The outer shell 10 may be created with a raft with supports at 40% strength, infill needs to be at 100% for all components and the gimbals can be printed standalone. One of the gimbals may need to be printed with a support for the threading. The outer shell 10 and the gimbals can be snapped together which then allows all components to spin freely.

As used in this application, the term "about" or "approximately" refers to a range of values within plus or minus 10% of the specified number. And the term "substantially" refers to up to 80% or more of an entirety. Recitation of ranges of values herein are not intended to be limiting, referring instead individually to any and all values falling within the range, unless otherwise indicated, and each separate value within such a range is incorporated into the specification as if it were individually recited herein.

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the present invention.

What is claimed is:

1. A fidget toy comprising:

four successive objects comprising:

a sphere being an innermost object of the four successive objects;

a hemispherical shell being an outmost object of the four successive objects; and two endless rings disposed between the sphere and the hemispherical shell, wherein the four successive objects are substantially concentric relative to each other; and a set of three gimbals, one gimbal mounted on adjacent objects of the four successive objects, wherein adjacent gimbals have alternating orthogonal pivot axis, wherein the set of three gimbals allows the four successive objects to move between a nested condition and a plurality of unnested conditions so that in the nested condition an outer surface of each of the two endless rings and the hemispherical shell are substantially coplanar, and wherein at least one third of the sphere projects beyond said outer surfaces in the nested condition while at least one-third is not visible in the nested condition, and wherein the hemispherical shell is dimensioned and shaped to be entirely cupped in a human hand so that the sphere and two endless rings spin freely relative to the cupped hemispherical shell.

2. The fidget toy of claim 1, wherein at least approximately ten percent of the sphere is visible past the two endless rings after the fidget toy is moved to each of the plurality of unnested conditions.

3. The fidget toy of claim 2, wherein an innermost gimbal and an outermost gimbal of the set of three gimbals have a parallel configuration so that they pivot about a shared axis, whereby the two endless rings and the sphere are locked in to only two degrees of freedom along three-dimensional space when the hemispherical shell is cupped in the human hand.

4. The fidget toy of claim 3, wherein each gimbal comprises two diametrically opposing pivot points.

5. The fidget toy of claim 4, wherein each pivot point comprises an outer surface tab and an inner surface slot.

6. The fidget toy of claim 5, wherein each tab and slot are conical.

7. The fidget toy of claim 6, wherein the fidget toy is manufactured by way of additive manufacture.

* * * * *